United States Patent [19]

Wood et al.

[11] 4,033,280

[45] July 5, 1977

[54] LIVE WELL FOR HIGH SPEED OPEN FISHING BOAT

[75] Inventors: Forrest L. Wood; Maurice (Mickey) Carroll Wood, both of Flippin, Ark.

[73] Assignee: Wood Manufacturing Company, Incorporated, Flippin, Ark.

[22] Filed: May 28, 1976

[21] Appl. No.: 691,014

[52] U.S. Cl. ..... 114/255; 9/1.1; 43/57

[51] Int. Cl.[2] ..... B63B 35/14

[58] Field of Search ..... 114/255, 291; 9/6 P, 9/1.1; 43/55–57; 119/3, 5

[56] References Cited

UNITED STATES PATENTS

| | | | |
|---|---|---|---|
| 2,729,183 | 1/1956 | Owen | 114/66.5 S |
| 2,936,542 | 5/1960 | Butler et al. | 43/57 |
| 3,499,243 | 3/1970 | Artin | 43/56 |
| 3,797,160 | 3/1974 | Lewis, Jr. | 43/55 |
| 3,822,498 | 7/1974 | Butler | 43/57 |
| 3,871,043 | 3/1975 | Davidson et al. | 9/6 P |

FOREIGN PATENTS OR APPLICATIONS

| | | | |
|---|---|---|---|
| 1,387,142 | 3/1975 | United Kingdom | 114/66.5 S |

*Primary Examiner*—Trygve M. Blix
*Assistant Examiner*—Stuart M. Goldstein
*Attorney, Agent, or Firm*—Colton & Stone, Inc.

[57] ABSTRACT

A high speed open fishing boat construction has a hull portion, a top liner portion joined to said hull portion, and a fish live well assembly formed integral with the top liner portion and positioned so that its center of gravity is located on the longitudinal centerline of the top liner portion. The improvement comprises a common water inlet-outlet located in the rear of the hull portion, an aerator connected in the live well assembly for spraying water therein, a pipeline system connecting the inlet-outlet port with the aerator, and a remotely controlled cut-off control valve connected in the pipeline system for opening and closing water flow through the inlet-outlet port.

7 Claims, 3 Drawing Figures

LIVE WELL FOR HIGH SPEED OPEN FISHING BOAT

BACKGROUND OF THE INVENTION

1. Field of the Invention

This invention is related generally to the fields of boat hull construction and fish holders, also known as live wells.

2. Description of the Prior Art

Fishermen, particularly in fishing tournaments, face the problem of getting to a favorite fishing location as quickly as possible in a power boat carrying live bait, catching as many fish as possible within a limited time period, and returning to the point of departure as quickly as possible with the caught fish still alive.

The use of live wells in fishing boats in order to keep bait and/or caught fish alive is common. The problem of preserving bait and/or caught fish in the live wells is particularly acute when a large number are held therein. Obviously, the water gives up oxygen quickly when there are many fish confined in a small area. Therefore, if the fisherman desires to preserve his catch alive, it is imperative that the water in the live wells be constantly fresh or continuously aerated so that the fish have sufficient oxygenated water to pass through their gills without becoming suffocated. Many types of live wells exist in the prior art to aid fishermen in preserving their catch. However, all prior art devices have one or more disadvantages which are overcome by the present invention. For example, portable live wells which are placed inside the boat may upset the balance of the boat while the live well is being shunted about. Fixed live wells that straddle the longitudinal center line of a boat hull overcome this problem of possible imbalance. Such centered live wells for providing better balance in motor-driven boats are old, as seen in German Patentschrift No. 24,746. One type of centered live well is a live well integral with the top liner of a boat hull. A good example of a live well integral with the top liner of a boat hull is shown in U.S. Pat. No. 3,871,043. However, such integral assemblies often have other disadvantages in delivering water to the live well. For example, an internal live well system having water inlet ports at the front, sides, or bottom of the boat, although satisfactory for slow-moving boats, create a substantial drag while a high speed boat is traveling. Ports at the rear are the only satisfactory water inlet locations for a high speed boat.

U.S. Pat. Nos. 2,151,225 and 2,936,542 show internal live well systems with ports at the rear of a motor-driven boat but there is some drag produced around the inlets of both systems while the boat is traveling. In U.S. Pat. No. 2,151,225, the water inlet is submerged near the base of a marine motor hung over the rear of the boat. In U.S. Pat. No. 2,936,542, the water inlet is in a scoop which extends from the rear of the boat.

The present invention produces no drag around the inlet port to the internal live well system because the port is located in the wall at the rear of the high speed boat. However, a siphon effect would be created through the rear port when the boat is traveling at high speed if the port is not closed before the boat begins to travel. This problem is overcome by placing a cut-off control valve in the pipeline system just inside the rear port in order to cut off the flow of water before the boat begins to travel.

Another problem exists in prior art devices in keeping an internal live well constantly replenished with oxygenated water in order to preserve the bait and/or caught fish. For example, the above mentioned U.S. Pat. No. 2,936,542 utilizes a scoop to draw in water to be aerated in the internal live well system while the boat is traveling and utilizes a compressed air container to oxygenate the water in the live well while the boat is sitting still. However, if the compressed air tank empties and there are no extra containers on board, as may happen on a long fishing trip, there is no way to keep the water in the live well fresh while the boat is sitting still except by hand dipping and dumping the water over the side of the boat.

The present invention overcomes the problem of keeping the live well constantly replenished with oxygenated water while the boat is either traveling or sitting still. The above mentioned cut-off control valve is shut while the boat is traveling so that the pump in the pipeline system constantly recirculates water to be aerated to each live well. The cut-off control valve is open while the boat is sitting still so that the pump constantly circulates fresh water between each live well and the body of water in which the boat is sitting.

SUMMARY OF THE INVENTION

The invention comprises a high speed open fishing boat having one or more live wells formed integral with the top liner of the boat hull and positioned so that the center of gravity of both live wells are located on the longitudinal centerline of said top liner. There is a water inlet-outlet port located along a vertical wall of a step near the rear of the boat for providing water from the body of water in which the boat is sitting to an internal pipeline system. The pipeline system has a cut-off control valve connected therein near the rear inlet-outlet port for opening and closing water flow therethrough. A water pump is also connected into said pipeline system for circulating water to said live wells and an aerator is connected into each live well for constantly spraying water therein. A water flow control valve is connected to each aerator for manually turning on and off the flow of water through the aerator.

While the boat is traveling, the cut-off control valve should be activated to close off water flow through the rear inlet-outlet port and the pump should be activated to constantly recirculate water to be aerated in each live well. Thus, a closed water circulation system is created without any siphon effect resulting through the rear inlet-outlet port. Also, the placement of said port in the rear wall of the boat hull insures that the port causes no drag.

While the boat is sitting still, the cut-off control valve should be activated to allow water flow through the rear inlet-outlet port and the pump may be activated to circulate fresh water from the body of water in which the boat is sitting to be aerated in each live well. Thus, an open water circulation system is created whereby the caught fish in each live well are supplied with fresh oxygenated water whenever needed for breathing.

DESCRIPTION OF THE PREFERRED EMBODIMENT

Figure 1:
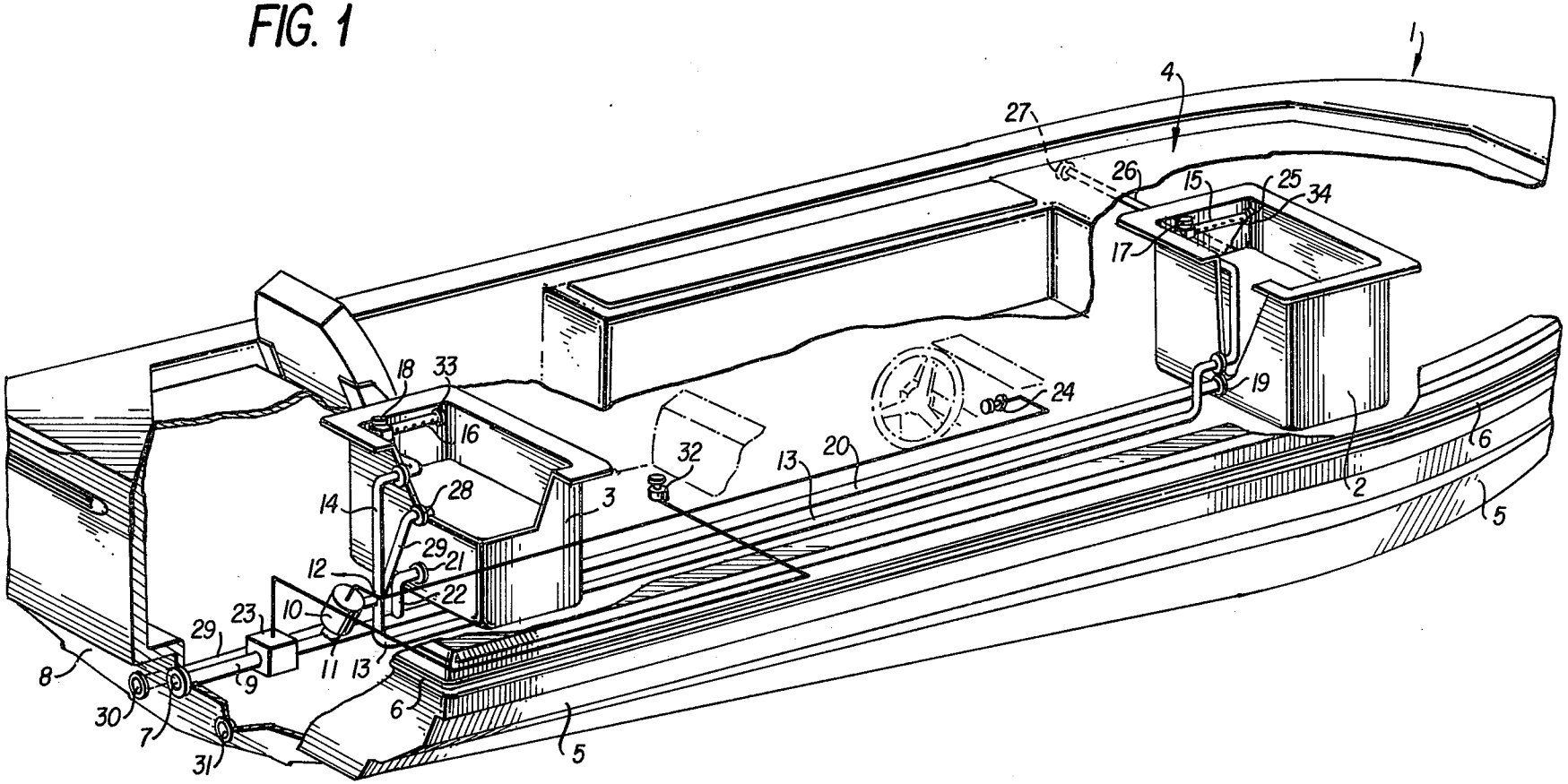
FIG. 1 is a cut-away isometric view of a high speed open fishing boat embodying the disclosed invention.
Figure 2:
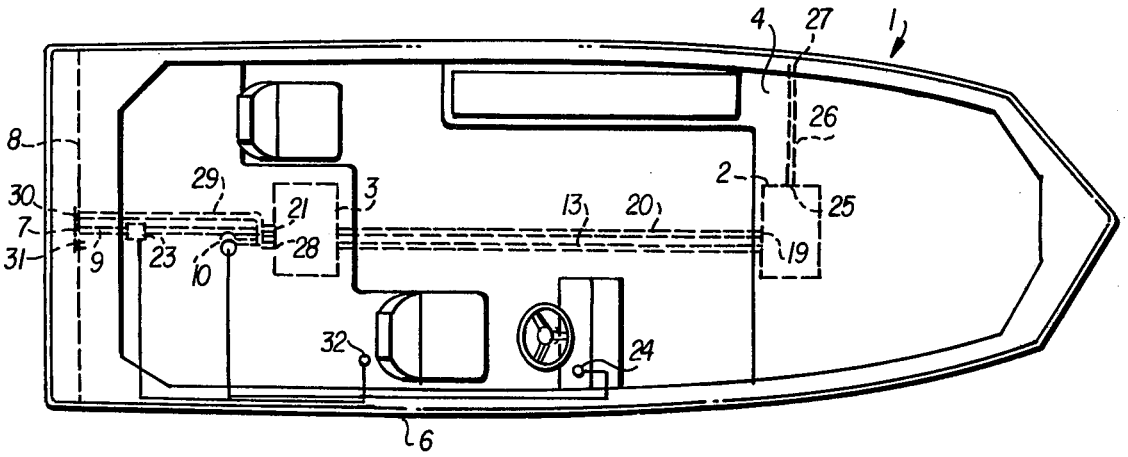
FIG. 2 is a top plan view of the boat, in particular showing in phantom lines the pipeline system of the invention.
Figure 3:
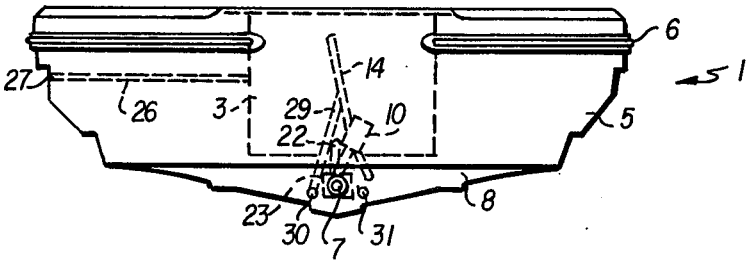
FIG. 3 is a rear view of the boat, in particular showing the water inlet and outlet ports.

A high speed open fishing boat 1 is powered by a conventional marine motor (not shown). A front live well 2 and a rear live well 3 are molded integral with the top liner 4. The live wells 2 and 3 straddle the longitudinal center line of the top liner 4, thus eliminating any possibility that the balance of the boat 1 will be upset when the live wells fill with water. The top liner 4 and a hull 5 are molded into separate units from lightweight plastic material, preferably fiberglass. The boat 1 is fabricated by joining together the top liner 4 and the hull 5 along a seam 6 to form a unitary structure.

However, before the top liner 4 and the hull 5 are joined together to form the boat 1, overflow pipe 26 is laid within the hull 5. After the top liner 4 and the hull 5 are joined together, the rest of the pipeline system is laid within the hull 5. The pieces of pipe are made of flexible poly vinyl chloride and are thus easily manipulated.

An inlet-outlet port 7 is centered along a wall 8 of a step near the rear of the hull 5. The port 7 allows water to enter into or be discharged from a common inlet-outlet pipe 9. A conventional one-way, relatively quiet operating water pump 10, when activated by means of a control button 24 on the driver's console, draws water from the common inlet-outlet pipe 9, into an inlet pipe tee 11, through the internal workings of the pump 10 and out through the feed pipe tee 12. The feed pipe tee 12 divides the flow so that about half of the water enters the feed pipe 13 to the front live well 2 and the rest of the water enters feed pipe 14 to the rear live well 3.

The water entering feed pipe 13 passes into an aerator 15 which constantly sprays the water into the front live well 2, thus providing oxygenated water needed for keeping the bait and/or caught fish alive. The water entering feed pipe 14 passes into an aerator 16 which constantly sprays the water into the rear live well 3. Manual water flow control valves 17 and 18 are located at the entrances to aerators 15 and 16, respectively, for turning on and off the spray into the live wells 2 and 3, respectively. Caps 34 and 33 are located on the ends of aerators 15 and 16, respectively, in order to force the water to spray through a plurality of holes in the bodies of the aerators. The aerators 15 and 16 are shown as linear in the drawings and may have any other conventional configuration, for example, rectangular or circular.

Water leaves the front live well 2 through outlet port 19 and flows down return pipe 20 to pipe tee 11. The water that leaves rear live well 3 through outlet port 21 passes down return pipe 22 to mix with the water in return pipe 20 and likewise reaches pipe tee 11. A water cut-off control valve 23 may be activated by occupant by means of a conventional manual push-pull valve control device 32 to open or shut off the flow of water in the common inlet-outlet pipe 9. When control valve 23 is open, pipe 9 functions as an outlet pipe to allow water flowing in return pipe 20 to pass through pipe tee 11 and to exit through port 7. When control valve 23 is activated to close pipe 9, the water flowing in return pipe 20 is forced to pass up through pipe tee 11, through the internal workings of pump 10, and recirculated through the pipeline system back to live wells 2 and 3.

An overflow port 25 draws off excess water in front live well 2, discharges it through overflow pipe 26, and out drain port 27 to run down along the outside of hull 5. The discharge flow rate is slow enough and the surface tension of the discharged water is strong enough to overcome any tendency of the discharged water to create a "spigot" effect. These factors, therefore, avoid making excessive noise that may scare away any fish that may be near the boat. Drain port 27 is shown on the port side of the hull 5 for illustrative purposes only. It is contemplated that the drain may be positioned on the starboard side or at any other location above the water line which does not create a drag while the boat is traveling at high speed. Similarly, an overflow port 28 draws off excess water in rear live well 3, discharges it through overflow pipe 29, and out drain port 30. Drain port 30 is located along the wall 8 of the step near the rear of the hull 5. A bilge drain 31 is also located along the wall 8 in order to draw off any water that accumulates inside the hull 5.

The invention operates in the following manner. Before the boat is put into the water, the control valve 23 is activated by control device 32 to close pipe 9 so that no water is allowed to enter the pipeline system leading to live wells 2 and 3. While the occupants travel at high speed to their favorite fishing location, the absence of water in the pipeline system and in the live wells allows the light weight boat to travel faster to the desired location. Once the location is reached and the boat 1 is brought to a standstill in the water, an occupant activates control valve 23 by means of control device 32 to open pipe 9, activates the pump 10 by means of control button 24, and manually opens the aerator flow control valves 17 and 18. Water enters port 7, passes through control valve 23, and flows up through pipe tee 11 into the internal workings of pump 10. Pump 10 forces the water into pipe tee 12 which divides the flow into feed pipes 13 and 14 leading to aerators 15 and 16, respectively. The water is constantly sprayed through the aerators 15 and 16 into the live wells 2 and 3, respectively. The live wells 2 and 3 fill with water until the level of the overflow ports 25 and 28, respectively, are reached. After the live wells 2 and 3 are filled with water, the boat 1 remains stable and balanced in the water because the filled live wells 2 and 3 straddle the longitudinal centerline of the boat.

After the live wells 2 and 3 fill to the level of the overflow ports 25 and 28, the occupants have the option to operate the pipeline system as either an open or a closed water circulation system. However, the open system is always preferred when the boat is sitting still in the water.

When the open system is chosen, the occupants allow the control valve 23 to remain open. Also, the pump 10 may be allowed to continue running and its operation will not disturb the fish in the body of water in which the boat is sitting because the pump runs relatively quietly. When the pump is left running in such an open system, fresh water continues to be constantly supplied by the pump 10 to the live wells 2 and 3 and the excess water flows out overflow ports 25 and 28, through overflow pipes 26 and 29 and out drain ports 27 and 30, respectively.

Alternatively, when the open system is chosen and after the occupants allow the control valve 23 to remain open, the pump 10 may be deactivated. When the pump is left off in such an open system, no fresh water is supplied by pump 10 to live wells 2 and 3. However, the water in the live wells will not drain back out through pipe 9 and port 7 because the entire attitude of boat 1 is inclined so that the rear end of the boat sits slightly lower in the water than the front end of the boat and this inclination causes the water pressure at port 7 and in pipe 9 to be greater than that at outlet ports 19 and 21, thereby overcoming any tendency of the water in live wells 2 and 3 to drain out.

Thus, after live wells 2 and 3 fill with water, any fish caught by the occupants are placed in the live wells in order to be kept alive. If the pump is left running, the caught fish constantly receive fresh water sprayed by aerators 15 and 16 into the live wells 2 and 3, respectively. If pump 10 is deactivated, the caught fish must periodically receive a shot of oxygenated water in order to be kept alive. The occupants of the boat inspect the condition of the fish and, if it is seen that the fish are weakening, they are rejuvenated when the occupants activate pump 10 by means of control button 24 in order to supply fresh oxygenated water. The water is drawn into port 1 and sprayed through aerators 15 and 16 into live wells 2 and 3, respectively.

If the occupants desire to use only live well 2 or 3, either flow control valve 18 or 17, respectively, may be turned off manually.

Before the occupants leave the fishing location to move to another spot or to return to the docking area with their catch, one precaution must be taken. If the open circulation system is in operation, the system must be changed over to a closed one by activating control valve 23 by means of control device 32 to close pipe 9. If the pump 10 is already activated, it is allowed to continue running but, if it is not in operation, the pump 10 must be activated by means of control button 24. In such a closed system, water is constantly fed by pump 10 through aerators 15 and 16 into live wells 2 and 3, respectively, out through outlet ports 19 and 21, respectively, and into return pipe 20 for recirculation to pump 10.

After returning to the docking area and unloading the catch, the live wells 2 and 3 and the pipeline system must be drained. This is accomplished in one of two ways.

First, an occupant shuts off pump 10 by means of control button 24 and activates control valve 23 by means of control device 32 to open pipe 9. The occupant then drives the boat on the body of water until all the water in live wells 2 and 3 are siphoned out the rear port 7. When the driver sees that the live wells 2 and 3 are empty, he activates control valve 23 by means of control device 32 to close pipe 9 in order to prevent the reentry of any water through port 7 once the boat is brought to a standstill.

If the boat is to be taken out of the water and loaded onto a trailer, an occupant may wish to drain the live wells 2 and 3 and the pipeline system in the second manner as follows. After the motor is deactivated and the pump 10 is shut off by means of control button 24, the boat is lifted out of the water and loaded onto its trailer. An occupant activates control valve 23 by means of control device 32 to open pipe 9 to allow the water in live wells 2 and 3 and the pipeline system to drain out through port 7 onto the ground.

The foregoing preferred embodiment is considered as illustrative only. Numerous modifications and changes will readily occur to those skilled in the art and, consequently, the disclosed invention is not limited to the exact construction and operation shown and described. For example, the pump 10 may be the reversible type rather than the one-way type. However, the latter is preferred because a reversible pump is, on the average, 5 or 6 times as expensive as a one-way pump. Also, three or four live wells may be formed integral with the top liner of a large fishing boat as long as the center of gravity of all live wells is located on the longitudinal centerline of the boat.

We claim:

1. In a boat construction having a hull portion, a top liner portion joined to said hull portion, a live well assembly formed integral with said top liner portion and positioned so that its center of gravity is located on the longitudinal centerline of said top liner portion, the improvement comprising:

a. a common water inlet-outlet port substantially flush with and located in the rear of said hull portion;

b. an aeration means connected in said live well assembly for spraying water therein;

c. a pipeline system connecting said inlet-outlet port with said aeration means; and d. a remotely controlled cut-off control valve means connected in said pipeline system for opening and closing water flow through said inlet-outlet port.

2. In a boat construction, according to claim 1, said water inlet-outlet port located in a step wall at the rear of said hull portion.

3. In a boat construction, according to claim 1, said water aeration means having a water flow control valve means for turning on and off the flow of water through said water aeration means.

4. In a boat construction, according to claim 1, a water pump means for circulating water from said water inlet-outlet port to said aeration means.

5. In a boat construction, according to claim 1, said pipeline system having a water pump means connected into said pipeline system between said inlet-outlet port and said aeration means.

6. In a boat construction, according to claim 5, said pipeline system having said cut-off control valve means connected into said pipeline system between said inlet-outlet port and said pump means.

7. In a boat construction having a hull portion, a step wall formed integral with said hull portion and located at the rear of said hull portion, a top liner portion joined to said hull portion, a live well assembly formed integral with said top liner portion and positioned so that its center of gravity is located on the longitudinal centerline of said top liner portion, the improvement comprising:

a. a water inlet-outlet port located in the rear of said hull portion;

b. a common inlet-outlet pipe having one end connected to said inlet-outlet port;

c. a cut-off control valve means, connected into said inlet-outlet pipe, for opening and closing water flow through said inlet-outlet pipe;

d. a water pump means having its inlet connected to the other end of said inlet-outlet pipe, for circulating water to said live well assembly;

e. a feed pipe connected at one end with the outlet from said pump means;

f. an aeration means connected to the other end of said feed pipe, for constantly spraying water into said live well assembly;

g. a water flow control valve means, connected to said aeration means, for turning on and off the flow of water through said water aeration means;

h. an overflow pipe connecting said live well assembly with the exterior of said hull portion; and i. a return pipe connected at one end near the base of said live well assembly and connected at the other end to the jointure of said inlet-outlet pipe with the inlet of said pump means.

* * * * *

Disclaimer and Dedication 4,033,280.—*Forrest L. Wood; Maurice (Mickey) Carroll Wood*, both of Flippin, Ark. LIVE WELL FOR HIGH SPEED OPEN FISHING BOAT. Patent dated July 5, 1977. Disclaimer and Dedication filed Aug. 11, 1988, by the assignee, Wood Manufacturing Co.,Inc.

Hereby disclaims and dedicates to the Public the remaining term of said patent.

[*Official Gazette May 2, 1989* ]